US006568973B2

(12) United States Patent
Testa

(10) Patent No.: US 6,568,973 B2
(45) Date of Patent: May 27, 2003

(54) SWIM OR DIVE FIN

(75) Inventor: Fabio Testa, Sarissola-Busalla (IT)

(73) Assignee: Salvas Sub S.p.A., Castelnuovo Scrivia (IT)

( * ) Notice: Subject to any disclaimer, the term of this patent is extended or adjusted under 35 U.S.C. 154(b) by 0 days.

(21) Appl. No.: 09/787,546

(22) PCT Filed: Feb. 21, 2001

(86) PCT No.: PCT/EP01/01959

§ 371 (c)(1),
(2), (4) Date: Mar. 20, 2001

(87) PCT Pub. No.: WO01/62354

PCT Pub. Date: Aug. 30, 2001

(65) Prior Publication Data

US 2003/0027469 A1 Feb. 6, 2003

(30) Foreign Application Priority Data

Feb. 21, 2001 (IT) ..... SV00A0008

(51) Int. Cl.[7] ..... A63B 31/08
(52) U.S. Cl. ..... 441/64
(58) Field of Search ..... 441/55, 60–64; D21/806, 807

(56) References Cited

U.S. PATENT DOCUMENTS

| | | | | | |
|---|---|---|---|---|---|
| 1,202,083 | A | * | 10/1916 | Mee | 441/55 |
| 1,729,477 | A | * | 9/1929 | Douglas | 441/55 |
| 1,788,013 | A | * | 1/1931 | Christianson | 441/64 |
| 2,321,009 | A | | 6/1943 | Churchill | |
| 2,729,832 | A | * | 1/1956 | Schmitz | 441/64 |
| 2,737,668 | A | | 3/1956 | Cressi | |
| 2,779,077 | A | | 1/1957 | Kline | |
| 3,082,442 | A | | 3/1963 | Cousteau et al. | |
| 3,178,738 | A | * | 4/1965 | La Trell | 441/64 |
| 3,411,165 | A | | 11/1968 | Murdoch | |

(List continued on next page.)

FOREIGN PATENT DOCUMENTS

| | | | | |
|---|---|---|---|---|
| AU | 9724727 | | 1/1998 | |
| CH | 351204 | * | 2/1961 | 441/64 |
| FR | 1014738 | * | 8/1952 | 441/64 |
| FR | 1208636 | * | 2/1960 | 441/64 |
| FR | 1238370 | * | 7/1960 | 441/64 |
| FR | 1351417 | * | 12/1963 | 441/64 |
| FR | 2115724 | | 7/1972 | |
| GB | 731198 | * | 6/1955 | 441/64 |
| GB | 2297695 | | 8/1996 | |
| IT | 602027 | * | 2/1960 | 441/64 |
| RU | 1066618 | | 1/1984 | |

*Primary Examiner*—S. Joseph Morano
*Assistant Examiner*—Ajay Vasudeva
(74) *Attorney, Agent, or Firm*—James Creighton Wray; Meera P. Narasimhan

(57) ABSTRACT

A swim fin comprises a footpocket (1) and a propelling blade (2), which has a central longitudinal member (3) for supporting and stiffening the blade (2). The blade (2) has at least one pair, preferably a plurality, of ribs (5) oriented toward the free end (4) of the blade (2) and extending from the central longitudinal member (3) to the peripheral edge (4, 6) of the blade (2). The gaps (6) between the ribs (5) are at least partly closed by at least one waterproof element, so that the fin has an in-fluid behavior and an exterior aspect which is comparable to a plume or a bird's feather.

125 Claims, 2 Drawing Sheets

U.S. PATENT DOCUMENTS

| | | | | | |
|---|---|---|---|---|---|
| 3,810,269 | A | | 5/1974 | Tabata et al. | |
| 4,300,255 | A | | 11/1981 | Beuchat | |
| 4,737,127 | A | | 4/1988 | Lamont | |
| 4,787,871 | A | * | 11/1988 | Tomlinson | 441/61 |
| 4,838,824 | A | | 6/1989 | McCredie | |
| 4,887,985 | A | | 12/1989 | Garofalo | |
| 4,954,112 | A | | 9/1990 | Negrini et al. | |
| 5,041,039 | A | * | 8/1991 | Chang | 441/64 |
| 5,183,424 | A | | 2/1993 | Field | |
| 5,304,081 | A | | 4/1994 | Takizawa | |
| 5,387,145 | A | | 2/1995 | Wagner | |
| 5,421,758 | A | * | 6/1995 | Watson et al. | 441/61 |
| 5,702,277 | A | | 12/1997 | Wagner | |
| 5,746,631 | A | | 5/1998 | McCarthy | |
| 6,050,868 | A | | 4/2000 | McCarthy | |
| 6,095,879 | A | | 8/2000 | McCarthy | |
| 6,146,224 | A | | 11/2000 | McCarthy | |
| 6,183,327 | B1 | | 2/2001 | Meyer | |

* cited by examiner

SWIM OR DIVE FIN

BACKGROUND OF THE INVENTION

The invention relates to a swim fin, comprising a seat for the foot, the so-called footpocket and a propelling blade, which has a central longitudinal member for supporting and stiffening the blade, substantially extending from the tip portion of the footpocket to the free end edge of the blade, thereby dividing the blade into two half-blades.

Various types of fins are known, which have a central longitudinal blade-stiffening member, designed to limit its resiliency and increase its propulsive force.

These prior art fins may include, on the surfaces of the two half-blades, a plurality of ribs or hollows, particularly axially oriented, for a better water canalization.

In accordance to another prior art fin, each of the two half-blades consists of a plurality of relatively resilient small blades extending outwards from the central longitudinal member. These small blades are spaced, and the gaps between each two small blades are open, and this reduces the capacity of the blade to take on water.

While these prior art fins have blades constructed in such a manner as to operate more effectively as compared with the traditional fins, they do not reach the ideal hydrodynamic behavior.

In certain cases, water is taken on by the fin in an unsatisfactory manner, otherwise it requires an excessively heavy blade, having an excess of moving masses, which require a considerable effort by the user.

SUMMARY OF THE INVENTION

Therefore, the present invention has the purpose to improve, by simple and inexpensive arrangements, a fin such as the one described hereinbefore, to achieve a better hydrodynamic behavior, closer to the optimum, and to obtain a greater propulsion with a lower muscular effort of the lower limbs, thereby reducing the risk of cramps. Particularly, a fin is desired which has a much lighter blade as compared with prior art fins, and at the same time an equal or even greater propulsive potential.

The invention achieves the above objects by providing a fin as described hereinbefore, in which the blade has at least one pair of additional rib-like stiffening members or the like, which are relatively rigid but resilient, each of which extends over a half-blade and branches off from the central longitudinal member to the corresponding side edge of the half-blade. The rest of the blade may be at least partly closed by at least one waterproof membrane-like element or the like, which has a higher resiliency than the ribs.

In accordance with a preferred embodiment, which will be described in greater detail with reference to the drawings, each half-blade may include a plurality of ribs branching off from the central longitudinal member. Said ribs may be spaced and the gaps between ribs may be closed at least partly by the above-mentioned waterproof element.

The ribs may be disposed in a substantially parallel arrangement, and oriented towards the free end of the blade. Hence, each of them forms an acute angle with the section of the central longitudinal member included between the rib attachment portion and the free end of the longitudinal member.

Like in other prior art fins, the central longitudinal member may be made of a relatively rigid, preferably thermoplastic material, and its width and/or thickness may decrease toward the free end thereof. Hence, it has a certain stiffness at the footpocked attachment portion and an increasing resiliency toward the free end of the blade.

Advantageously, the central longitudinal member may have, in its thickest portion, i.e. in the footpocket attachment portion, and particularly immediately before the beginning of the bottom side thereof, one or more weakened areas, consisting of inserts, notches or the like, for a local increase of resiliency.

The ribs may be made of a relatively rigid plastic material, particularly of the same thermoplastic material as the central longitudinal member, and are arranged symmetrically with reference to the median longitudinal axis of the blade, i.e. to the central longitudinal member.

On each half-blade a rib may end at and form the corner portion of the half-blade near the free end of the blade.

The ribs which end at the lateral edges of the blade and at the two corner ends may have the same length and/or width and/or thickness, or a different width and/or length and/or thickness.

The gaps between every pair of ribs may be equal or different in width with respect to each other and/or to the ribs, but preferably all have substantially the same width as the ribs.

The closing elements, the membranes or the portions of the closing element between every pair of ribs may be thinner than the ribs, or have the same thickness and extend flush therewith on one or both faces of the blade.

The closing elements, the membranes or the portions of the closing element between every pair of ribs may have the same length as the ribs for an optimal thrust through water.

The gaps between ribs may be closed by a single element, which may be a film, a sheet or the like, extending in such a manner as to cover the whole surface of at least one face of the blade and fastened onto the surface of the ribs by chemical/physical bonding, e.g. welding, gluing, or the like.

In a particular embodiment, both faces of the blade may be covered by a film, a sheet or other similar element.

Alternatively, the gaps between ribs may be closed, at least partly by a plurality of elements in the form of films, sheets or the like, applied and welded along the inner edges of the adjacent ribs, in such a manner as to extend flush with one of the faces of the blade.

As a further alternative, said gaps may be closed, at least partly, by a plurality of resilient filling elements, each interposed between a pair of adjacent ribs, which may have the same thickness as the ribs, so as to extend flush with the two faces of the blade or a lower thickness.

Said resilient closing elements may be made by injecting a filling material into the gaps between adjacent ribs. Alternatively, prefabricated resilient members may be inserted and fastened by chemical/physical bonding on the inner edges of the ribs.

Materials with a good resiliency though with no extensibility may be used as closing materials, e.g. synthetic thermoplastic materials, such as polyethylene, polyurethane, polypropylene, PVC, EVA, PTE, or the like, or one or more layers made of artificial and/or synthetic and/or natural braided, woven or otherwise processed resins.

Alternatively, materials having a good resiliency and a certain extensibility may be used to close the gaps, e.g. thermoset rubber, or the like, to achieve a particular hydrodynamic behavior.

The whole surface of the blade may be closed in a waterproof manner or one or more apertures for water passage may be provided at predetermined locations, designed, for example, to increase the resiliency of these areas and/or to decrease pressure on water.

The ribs may be directly connected to the central longitudinal member, or there may be provided, at least for some of the ribs, higher resiliency connection portions having a hinging effect, preferably disposed next to the longitudinal member.

Particularly, for each rib, the portion having a hinging effect may include, at least for some of the ribs, one or more weakening grooves provided on one or both faces of the rib.

Alternatively, for each rib, the portion having a hinging effect may include, at least for some of the ribs, an elongated aperture which extends on a portion of the rib width. Hence, the rib is connected to the longitudinal member by two highly resilient bridges of material at the ends of the aperture.

As a further alternative, there may be provided, for at least some of the ribs, a plurality of bore-like apertures, or the like. Therefore, each rib is connected to the central longitudinal member by a plurality of bridges of material.

In the footpocket attachment portion, the blade may have two apertures for water passage, one on each side of the footpocket.

Particularly, the blade may have two substantially triangular members, situated on opposite sides with respect to the longitudinal member, consisting each of a relatively rigid plastic frame, which will be described below in greater detail.

These frame-like members may be closed, at least partly, like the gaps between the ribs, or otherwise, e.g. by means of a more rigid closing element, but preferably have each a substantially triangular aperture for water passage.

At the free end portion of the longitudinal member there may be provided a pair of end ribs, preferably having a smaller width and length than the others, which branch off from the longitudinal member and reach the edge of the free end of the blade.

These two ribs may be connected together along the edge of the free end of the blade by a transverse member, in such a manner as to form therewith a substantially triangular element, divided into halves by the end section of the longitudinal member.

This element may be closed like the gaps between the ribs, or in a different manner, or may be at least partly open and have two apertures on opposite sides of the longitudinal member.

The advantages of the present invention are self-evident from the above description and consist in that a novel fin may be provided by simple and inexpensive arrangements, which allows to achieve a better hydrodynamic behavior, closer to the optimum. An increased propulsion can be obtained with a smaller muscular effort of the lower limbs, especially thanks to the fact that the fin of the invention includes a blade which has a highly peculiar structure, whereby it is much lighter than prior art fins. The fin has an in-fluid behavior comparable to that of a plume or a bird's feather, and has a propulsive capacity equal to or higher than prior art fins.

Further characteristics and improvements of the invention will form the subject of the dependent claims.

The characteristics of the invention and the advantages derived therefrom will be more apparent from the following detailed description of the annexed drawings, which:

BRIEF DESCRIPTION OF THE INVENTION

FIG. 6 shows in continues and dashed lines the behavior of the

DETAILED DESCRIPTION blade in the reciprocating kicking strokes.

Figure 1:
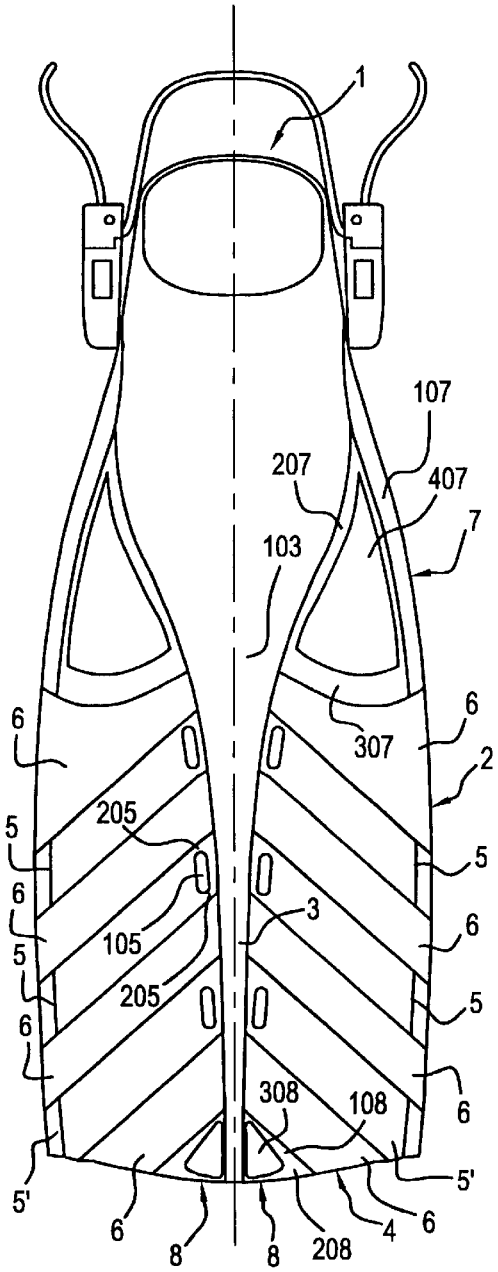
FIG. 1 is a top plan view of a fin according to the invention.

Referring to FIG. 1, the fin is composed of a seat for the foot, the so called footpocket 1, and of a blade part 2.

The footpocket 1, which may be of the closed type, of the open-heel type with a fastening strap or of any other type, is preferably made of a soft material, such as rubber, or the like.

The blade 2 has a single central longitudinal member 3, for supporting and stiffening the blade 2. Said longitudinal member 3 extends from the tip portion of the footpocket 1 wherewith it is progressively connected, up to the edge 4 of the free end of the blade 2 and divides the blade 2 into two half-blades, such that the fin is symmetric with respect to its median longitudinal axis, whereby the right fin is interchangeable with the left fin. Hence, fabrication and distribution costs may be reduced. Nevertheless, for particular applications, non-symmetric blade fins may be provided.

The longitudinal member 3 connects to the footpocket in a substantially triangular widened portion 103 and tapers toward the end edge 4, with a decreasing width.

Figure 3:
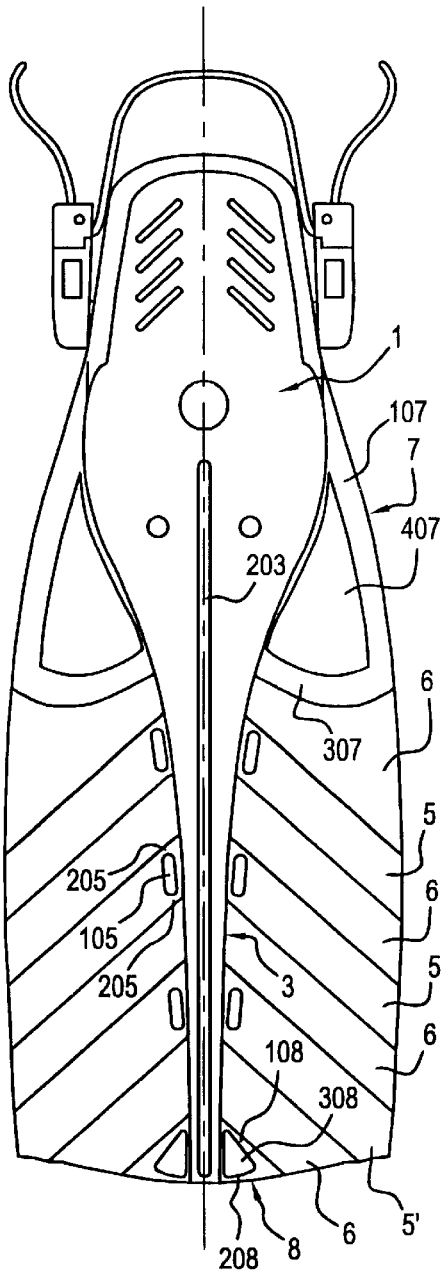
FIG. 3 is a bottom plan view of the fin as shown in FIG. 1.
Figure 2:
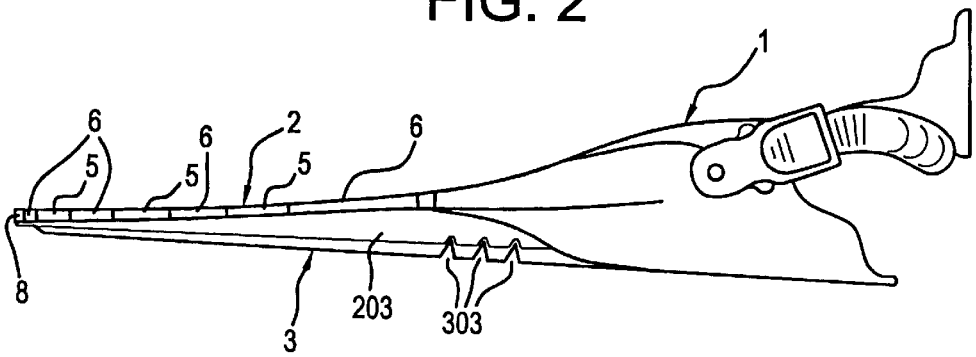
FIG. 2 is a side view of the fin as shown in FIG. 1.
Figure 4:
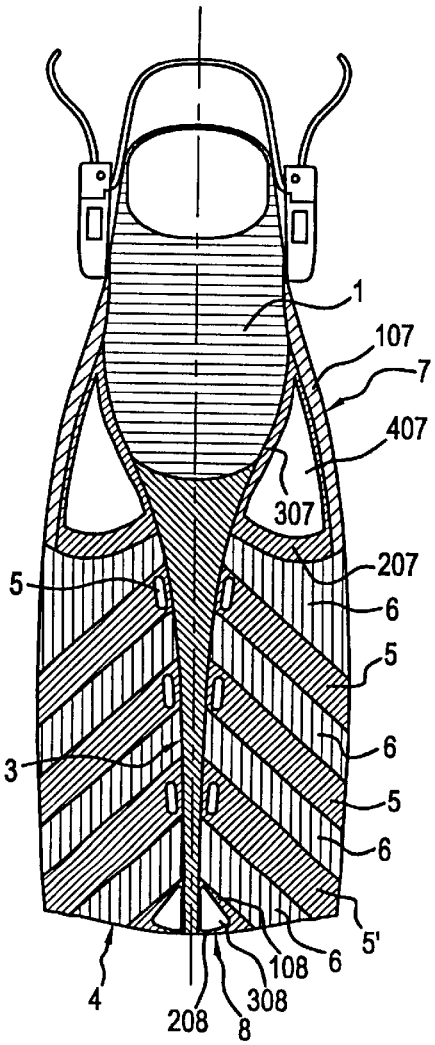
FIG. 4 is a sectional view as taken along an intermediate surface of the blade thickness, wherein the different materials thereof are shown.

With reference to FIGS. 2 and 3, the longitudinal member 3 has a stiffening longitudinal axial rib 203 at the rear face of the blade 2, which is perpendicular to the surface of the blade 2 and whose height decreases toward the end edge 4, so that the longitudinal member 3 has an increasing resiliency as it approaches said edge 4. Thanks to the fact that the longitudinal member 3 has a substantially T-shaped section it has a very light weight, although it provides an appropriate support to the blade 2.

The rib 203 has, in its highest section with respect to the rear surface of the blade 2, i.e. in the portion connected to the footpocket 1, and particularly immediately before the beginning of the bottom side thereof, a plurality of weakening inserts or notches 303, for a local increase of resiliency of the longitudinal member 3. Said longitudinal member 3 consists of a relatively rigid, preferably thermoplastic material.

Each half-blade comprises a plurality of ribs 5 branching off from the central longitudinal member 5 and reaching the corresponding side edge 6 of the half-blade. They are parallel and oriented toward the free end 4 of the blade 2. In the illustrated embodiment, there are three such ribs 5 for each half-blade, and all have the same length, width and thickness, but they may be provided in a different number with different lengths and/or widths and/or thicknesses from each other, depending on the particular hydrodynamic behavior to be achieved.

The ribs 5 are symmetrically arranged with reference to the median longitudinal axis of the blade, and are preferably made of a relatively rigid plastic material, particularly of the same material as the central longitudinal member 3, although they have a higher resiliency. On each half-blade a rib 5' ends at the corner portion of the half-blade proximate to the free end 4 of the blade 2 and forms the edge thereof.

In the portion connected to the longitudinal member 3, each rib 5, 5' has an elongated aperture 105 for water passage, which aperture extends parallel to the longitudinal member 3 through a portion of the width of the rib 5, 5', so that the rib 5, 5' is connected to the longitudinal member by two bridges 205 of material, each at an end of the aperture 105. By this arrangement, each rib 5, 5', when subject to water thrust, can perform a hinge-like movement with respect to the central longitudinal member 3. The amplitude of this movement essentially depends on the length of the weakening aperture 105. Alternatively, one or more weakening grooves and/or one or more bore-like apertures or the like may be provided on one or both faces of the rib 5, 5'.

The ribs 5, 5' are spaced and the gaps between the ribs 5, 5' are closed by a waterproof membrane-like element 6 or the like, which is more resilient than the ribs 5, 5', fully covers the ribs 5, 5' on both faces and is attached thereto by chemical/physical bonding. For example, a hot overinjection of a suitable material may be provided, so that the ribs 5, 5' are sunk in this material and the gaps between the ribs 5, 5' are closed by a layer of material, preferably much thinner than the ribs 5, 5'. By this arrangement, each half-blade is composed of a plurality of ribs 5, 5' and of a plurality of closing elements substantially having the same width and length as the ribs 5, 5', but a lower thickness and a higher resiliency. Several different arrangements may be provided. As described above, a film of material may be glued on one or both faces of the blade 2, or a filling material may be hot-injected in the gaps 6 between adjacent ribs 5, 5', or prefabricated resilient elements may be inserted and fastened by chemical/physical bonding onto the inner edges of the ribs 5, 5'. To this end, the ribs 5, 5' may have a matching tooth or a coupling groove, or the like.

Materials like polyethylene or the like may be used to close the gaps between ribs 5, 5', i.e. materials having a good resiliency but no extensibility, or materials like thermoset rubber or the like, which have both a good resiliency and a certain extensibility.

Advantageously, the closing elements between adjacent ribs 5, 5' may have a different color from the ribs 5, 5' and/or the central longitudinal member 3, in order to emphasize the plume or bird's feather structure of the blade 2. Particularly, they may have a transparent color which can provide the fin with a highly attractive aspect.

In the portion of the blade 2 proximate to the footpocket 1 the fin has two substantially triangular members 7 situated on opposite sides with respect to the longitudinal member 3. Each of these members 7 consists of a relatively rigid plastic frame which is in turn composed of a first element 107 branching off from the footpocket 1 and widening toward the outside of the blade 2 to form the starting portion of the peripheral edge, of a second element 207 branching off from the footpocket 1 and narrowing toward the median longitudinal axis of the blade, in the substantially triangular narrowing area 103 which leads from the footpocket 1 to the longitudinal member 3, and of a third transverse element 307 for connecting the ends of the first two elements 107, 207, turned toward the free end 4 of the blade 2. Each of said triangular elements 7 has a substantially triangular aperture 407 for water passage and may increase the resiliency of the blade 2 in the portion connected to the footpocket 1. Alternatively, they may be closed, at least partly, like the gaps between the ribs 5, 5', or otherwise, e.g. by a sheet of a material like the one of the ribs 5, 5'

In the central portion proximate to the edge 4 of its free end, the blade 2 has a pair of end ribs 108, having smaller width and length than the others, which branch off from the longitudinal member 3 and reach the edge 4 of the free end of the blade 2. Said end ribs 108 are connected together by a cross member 208, which extends along the edge 4 of the free end of the blade 2, in such a manner as to form therewith a substantially triangular element 8, divided into halves by the end section of the longitudinal member 3. This triangular member 8 has a pair of apertures 308 on opposite sides of the longitudinal member 3, but may be wholly closed like the ribs 5, 5', or in a different manner.

Figure 5:
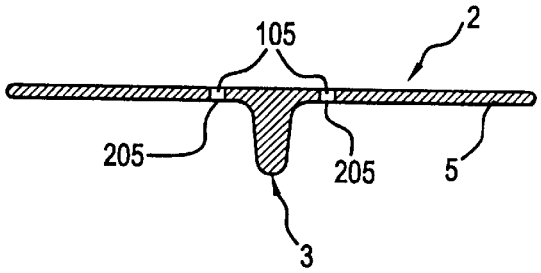
FIG. 5 is a simplified cross sectional view of the blade in the rest condition.
Figure 6:
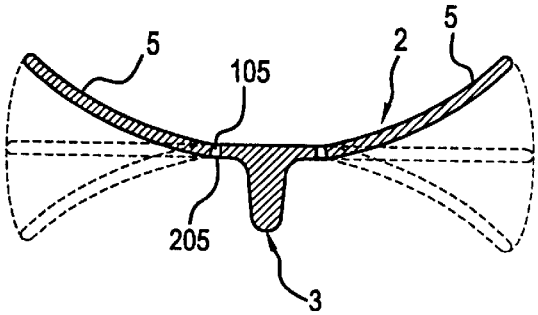

FIGS. 5 and 6 are very schematic views of the behavior of the blade 2 in the rest condition and in the upstroke and downstroke respectively. It is apparent that, during kicking strokes, the blade is arched by the action of water, and has a shape and a behavior comparable to those of a plume or a bird's feather in air. Resistance to blade motion in the fluid and losses due to vortices, non laminar flows or cavitations are considerably reduced, without affecting the dynamic thrust, i.e. the dynamic performance of the fin and reducing at the same time the effort exerted by the user in response to the part absorbed by non laminar flow occurrences, hence not turned into forward motion.

According to another characteristic, the central longitudinal member 3 may have an additional protruding longitudinal rib 303 on the upper side of the blade, with reference to the standing position of the user, and this rib, or the like may also have, like the lower rib, notches or hollows or recesses 303, which enhance or anyway control the longitudinal resiliency in several areas.

While the membrane elements 6 as shown in the figures have the same thickness as the ribs 5, 5' wherebetween they are interposed, they may also have different thicknesses, depending on the desired effect on the overall deformability of the blade and of the material used for these elements 6, and typically are much thinner than the ribs 5, 5' and as thin as typical films, membranes or the like, whereas the ribs have a greater thicknesses, of the order of a few millimeters.

Obviously, the invention is not limited to the embodiment described and illustrated herein, but may be greatly varied, especially as regards construction, without departure from the guiding principle disclosed above and claimed below.

I claim:

1. A swim fin, comprising a footpocket (1) and a propelling blade (2), which has a central longitudinal member for supporting and stiffening the blade, substantially extending from a tip portion of the footpocket (1) to a free end edge (4) of the blade (2), thereby dividing the blade (2) into two half-blades, characterized in that the blade (2) has at least one pair of additional stiffening members (5, 5'), which are relatively rigid but resilient, each of which extends over a half-blade and branches off from the central longitudinal member (3) to the corresponding side edge (6) of the half-blade, the rest of the blade (2) being at least partly closed by at least one waterproof element, having a higher resiliency than the ribs (5, 5').

2. A fin as claimed in claim 1, characterized in that each half-blade has a plurality of ribs (5, 5') which branch off from the central longitudinal member (3), said ribs (5, 5') being spaced, and the gaps between the ribs (5, 5') being at least partly closed by the at least one waterproof element (6).

3. A fin as claimed in claim 2, characterized in that the ribs (5, 5') are disposed in a substantially parallel arrangement, and oriented toward the free end (4) of the blade (2), so that each of them forms an acute angle with a section of the central longitudinal member (3) included between a rib (5, 5') attachment portion and a free end of the longitudinal member (3).

4. A fin as claimed in claim 1, characterized in that the central longitudinal member (3) is made of a relatively rigid material, and its width (3) or thickness (203) decreases toward its free end thereof to have a certain rigidity in a portion connected to the footpocket (1) and an increasing resiliency toward the free end (4) of the blade (2).

5. A fin as claimed in claim 4, wherein the rigid material is thermoplastic material.

6. A fin as claimed in claim 1, characterized in that the central longitudinal member (2) has, in its thickest portion connected to the footpocket (1), and immediately before the beginning of the bottom side thereof, one or more weakened areas, consisting of inserts or notches (303), for a local increase of resiliency.

7. A fin as claimed in claim 1, characterized in that the ribs (5, 5') are made of a relatively rigid but resilient plastic material.

8. A fin as claimed in claim 7, wherein the resilient plastic material is of thermoplastic material similar to a thermoplastic material forming the central longitudinal member (3).

9. A fin as claimed in claim 1, characterized in that the ribs (5, 5') are arranged symmetrically with reference to a median longitudinal axis of the blade (2) or to the central longitudinal member (3).

10. A fin as claimed in claim 1, characterized in that on each half-blade a rib (5') ends at and forms a corner portion of the half-blade near the free end (4) of the blade (2).

11. A fin as claimed in claim 1, characterized in that the ribs (5, 5') which end at the lateral edges of the blade (2) and at two corner ends have same dimensions.

12. A fin as claimed in claim 11, wherein the dimensions are selected from a group consisting of length, width, thickness, and combinations thereof.

13. A fin as claimed in claim 1, characterized in that the ribs (5, 5') which end at the lateral edges of the blade (2) and at two corner ends have different dimensions.

14. A fin as claimed in claim 13, wherein the dimensions are selected from a group consisting of width, length, thickness, and combinations thereof.

15. A fin as claimed in claim 1, characterized in that the gaps between every pair of ribs (5, 5') may be equal or different in width with respect to each other.

16. A fin as claimed in claim 15, wherein the gaps are of equal or different widths with respect to the ribs (5, 5').

17. A fin as claimed in claim 1, characterized in that the gaps between every pair of ribs (5, 5') have the same width as the ribs (5, 5').

18. A fin as claimed in claim 1, characterized in that closing elements, the membranes or the portions of the closing element between every pair of ribs (5, 5') are thinner than the ribs (5, 5'), or have the same thickness and extend flush therewith on one or both faces of the blade (2).

19. A fin as claimed in claim 1, characterized in that closing elements, the membranes or the portions of the closing element between every pair of ribs (5, 5') are as long as the ribs (5, 5').

20. A fin as claimed in claim 1, characterized in that the gaps between ribs (5, 5') are closed by a single element, extending to cover the whole surface of at least one face of the blade (2) and fastened onto the surface of the ribs (5, 5') by chemical/physical bonding.

21. A fin as claimed in claim 20, wherein the single element is a film or a sheet.

22. A fin as claimed in claim 20, wherein the bonding is selected from a group consisting of welding, gluing, or combinations thereof.

23. A fin as claimed in claim 1, characterized in that both faces of the blade (2) is covered by an element.

24. A fin as claimed in claim 23, wherein the element is a film or a sheet.

25. A fin as claimed in claim 1, characterized in that the gaps between ribs (5, 5') are closed, at least partly by a plurality of elements, applied and welded along the inner edges of adjacent ribs (5, 5'), to extend flush with one of the faces of the blade (2).

26. A fin as claimed in claim 25, wherein the elements include films or sheets.

27. A fin as claimed in claim 1, characterized in that gaps (6) between ribs (5, 5') are closed, at least partly, by a plurality of resilient filling elements, each interposed between a pair of adjacent ribs (5, 5'), which have the same thickness as the ribs (5, 5'), so that they extend flush with both faces of the blade (2).

28. A fin as claimed in claim 27, wherein the resilient filling elements have a smaller thickness than the ribs.

29. A fin as claimed in claim 1, characterized in that resilient closing elements are obtained by injecting a filling material into the gaps between adjacent ribs (5, 5') or that prefabricated resilient elements are inserted and fixed by chemical/physical bonding to inner edges of the ribs (5, 5').

30. A fin as claimed in claim 1, characterized in that materials with a good resiliency though with no extensibility are used to close the gaps between ribs (5, 5').

31. A fin as claimed in claim 30, wherein the materials with good resiliency and no extensibility are synthetic thermoplastic materials.

32. A fin as claimed in claim 31, wherein the materials are selected from the group consisting of polyethylene, polyurethane, polypropylene, PVC, EVA, PTE, or combinations thereof.

33. A fin as claimed in claim 31, wherein the materials are processed resins.

34. A fin as claimed in claim 33, wherein the resins are one or more layers selected from the group consisting of artificial, synthetic, natural braided, woven resins, and combinations thereof.

35. A fin as claimed in claim 1, characterized in that materials having both a good resiliency and a certain extensibility are used to close the gaps between ribs 5, 5'.

36. A fin as claimed in claim 35, wherein the materials are thermoset rubber materials.

37. A fin as claimed in claim 1, characterized in that a whole surface of the blade (2) is closed in a waterproof manner.

38. A fin as claimed in claim 37, wherein the blade comprises one or more apertures (407) for water passage disposed at predetermined locations.

39. A fin as claimed in claim 1, characterized in that the ribs (5, 5') are directly connected to the central longitudinal member (3), or there is provided, at least for some of the ribs (5, 5'), higher resiliency connection portions having a hinging effect disposed next to the longitudinal member (3).

40. A fin as claimed in claim 1, characterized in that, for each rib (5, 5'), a portion having a hinging effect includes, at least for some of the ribs (5, 5'), one or more weakening grooves provided on one or both faces of the rib (5, 5').

41. A fin as claimed in claim 1, characterized in that, for each rib (5, 5'), a portion having a hinging effect includes, at least for some of the ribs (5, 5'), an elongated aperture (105), which extends through a portion of the width of the rib (5, 5'), 50 that the rib (5, 5') is connected to the longitudinal member (3) by two bridges (205) of material, each at an end of the aperture (105).

42. A fin as claimed in claim 1, characterized in that, for each rib (5, 5'), the portion having a hinging effect includes, at least for some of the ribs (5, 5'), a plurality of apertures, so that each rib (5, 5') is connected to the longitudinal member (3) by a plurality of bridges of material.

43. A fin as claimed in claim 1, characterized in that in a portion connected to the footpocket (1), the blade (2) has two apertures (407), one on each side of the footpocket (1).

44. A fin as claimed in claim 1, characterized in that the fin has two substantially triangular members (7), located on opposite sides of the longitudinal member (3), each consisting of a relatively rigid plastic frame which is in turn composed of a first element (107) branching off from the footpocket (1) and widening toward the outside of the blade (2) to form the starting portion of the peripheral edge, of a second element (207) branching off from the footpocket (1) and narrowing toward the median longitudinal axis of the blade (2), in a substantially triangular narrowing area which leads from the footpocket (1) to the longitudinal member (3), and of a third transverse element (307) for connecting the ends of the first two elements (107, 207), turned towards the free end of the blade (2).

45. A fin as claimed in claim 1, characterized in that triangular frame members (7) are closed, at least partly.

46. A fin as claimed in claim 45, wherein the triangular frame members (7) have each a substantially triangular aperture (407) for water passage.

47. A fin as claimed in claim 1, characterized in that at the free end portion (4) of the longitudinal member (3) there is provided a pair of end ribs (108), which branch off from the longitudinal member (3) and reach the edge (4) of the free end of the blade (2).

48. A fin as claimed in claim 47, wherein the pair of end ribs (108) have a smaller width and length than other ribs.

49. A fin as claimed in claim 1, characterized in that the two end ribs (108) are connected together along the edge (4) of the free end of the blade (2) by a transverse member (208), to form therewith a substantially triangular element (8), divided into halves by the end section of the longitudinal member (3).

50. A fin as claimed in claim 1, characterized in that a triangular element (8) are closed, or are open and have two apertures (308) on opposite sides of the longitudinal member (3).

51. A fin as claimed in claim 1, characterized in that the ribs and membrane portions therebetween have different colors.

52. A fin as claimed in claim 1, characterized in that membranes on the fin are transparent at least in the areas between ribs.

53. A fin as claimed in claim 1, characterized in that the ribs are made of an non-transparent material.

54. A swim fin, comprising a footpocket and a propelling blade, a central longitudinal member on the blade for supporting and stiffening the blade, the footpocket having a tip portion and the blade having a free end edge, the central longitudinal member substantially extending from the tip portion of the footpocket to the free end edge of the blade and dividing the blade into two half-blades having respective side edges, at least one pair of stiffening members forming ribs on the blade, wherein the ribs are relatively rigid but resilient, each rib extending over a half-blade and branching off from the central longitudinal member to a corresponding side edge of the half-blade, at least one waterproof closure for at least partly closing the blade, the at least one waterproof closure having a higher resiliency than a resiliency of the ribs.

55. The fin of claim 54, wherein each half-blade comprises a plurality of ribs branching off from the central longitudinal member and gaps between the ribs for spacing the ribs, wherein the gaps between the ribs are at least partly closed by the at least one waterproof closure.

56. The fin of claim 55, wherein the ribs further comprise rib attachment portions, wherein the ribs are disposed substantially parallelly and the ribs are oriented toward the free end edge of the blade, wherein each rib forms an acute angle with a section of the central longitudinal member included between the rib attachment portion and a free end of the longitudinal member.

57. The fin of claim 55, wherein the central longitudinal member is of a relatively rigid material, and the central longitudinal member comprises a decreasing width or thickness towards a free end of the longitudinal member, and a rigid portion of the central longitudinal member being connected to the footpocket and having an increasing resiliency towards the free end edge of the blade.

58. The fin of claim 57, wherein the rigid material is thermoplastic material.

59. The fin of claim 57, wherein the rigid portion of the central longitudinal member connected to the footpocket is a thickest portion of the central longitudinal member.

60. The fin of claim 59, wherein the central longitudinal member has at least one weakened area immediately preceding a beginning portion of a bottom side of the central longitudinal member, wherein the at least one weakened area comprises inserts or notches for increasing resiliency locally.

61. The fin of claim 55, wherein the ribs are of a relatively rigid but resilient material.

62. The fin of claim 61, wherein the relatively rigid but resilient material is plastic material.

63. The fin of claim 62, wherein the resilient plastic material is thermoplastic material and is similar to a thermoplastic material forming the central longitudinal member.

64. The fin of claim 55, wherein the ribs are disposed symmetrically with reference to a median longitudinal axis of the blade.

65. The fin of claim 55, wherein the ribs are disposed symmetrically with reference to a median longitudinal axis of the central longitudinal member.

66. The fin of claim 55, further comprising rib ends on the ribs and a corner portion on each half-blade formed by the rib ends proximal the free end edge of the blade.

67. The fin of claim 55, wherein the blade further comprises two lateral edges and two corner ends and wherein dimensions of the ribs at the lateral edges and at the two corner ends are same.

68. The fin of claim 67, wherein the dimensions are selected from a group consisting of length, width, thickness, and combinations thereof.

69. The fin of claim 55, wherein the blade further comprises two lateral edges and two corner ends and wherein dimensions of the ribs at the lateral edges and at the two corner ends are different.

70. The fin of claim 69, wherein the dimensions are selected from a group consisting of width, length, thickness, and combinations thereof.

71. The fin of claim 55, wherein the gaps between each pair of ribs are equal in width with respect to each other.

72. The fin of claim 55, wherein the gaps between each pair of ribs are different in width with respect to each other.

73. The fin of claim 55, wherein the gaps are of equal widths with respect to the ribs.

74. The fin of claim 55, wherein the gaps are of different widths with respect to the ribs.

75. The fin of claim 55, wherein the gaps between every pair of ribs are of the same width as the ribs.

76. The fin of claim 55, wherein the at least one closure has portions between every pair of ribs thinner than the ribs.

77. The fin of claim 55, wherein the at least one closure has portions having same thickness as the ribs.

78. The fin of claim 77, wherein the at least one closure extends flush along both faces of the blade.

79. The fin of claim 55, wherein the at least one closure extends flush along at least one face of the blade.

80. The fin of claim 55, wherein the at least one closure has portions between every pair of ribs having lengths as long as the ribs.

81. The fin of claim 80, further comprising bonding for fastening the closing element onto a surface of the ribs.

82. The fin of claim 81, wherein the bonding is a chemical or a physical bonding.

83. The fin of claim 82, wherein the bonding is selected from a group consisting of welding, gluing, or combinations thereof.

84. The fin of claim 55, further comprising a closing element for closing the gaps between the ribs, the closing element extending to cover an entire surface of at least one face of the blade.

85. The fin of claim 84, wherein the single element is a film or a sheet.

86. The fin of claim 55, further comprising a closing element for closing the gaps between the ribs, the closing element extending to cover both faces of the blade.

87. The fin of claim 86, wherein the element is a film or a sheet.

88. The fin of claim 55, further comprising a plurality of closing elements for at least partly closing the gaps between the ribs.

89. The fin of claim 88, wherein the plurality of closing elements are disposed along inner edges of adjacent ribs to extend flush with one of the faces of the blade.

90. The fin of claim 89, wherein the plurality of closing elements are welded along the edges of the adjacent ribs.

91. The fin of claim 88, wherein the elements include films or sheets.

92. The fin of claim 55, further comprising a plurality of resilient closing elements for at least partly closing the gaps between the ribs, and each of the resilient closing elements being interposed between a pair of adjacent ribs.

93. The fin of claim 92, wherein each of the resilient closing elements having a same thickness as a thickness of the ribs.

94. The fin of claim 93, wherein the resilient closing elements extend flush with both faces of the blade.

95. The fin of claim 92, wherein each of the resilient closing elements have a smaller thickness than a thickness of the ribs.

96. The fin of claim 92, wherein the resilient closing elements are formed of injected filling material injected into the gaps between the adjacent ribs.

97. The fin of claim 92, wherein the resilient closing elements are prefabricated resilient elements disposed along inner edges of the ribs.

98. The fin of claim 97, further comprising bonding for fixing the resilient closing elements.

99. The fin of claim 98, wherein the bonding is chemical or physical bonding.

100. The fin of claim 55, further comprising closing elements for closing the gaps between the ribs, wherein the closing elements are of materials having a good resiliency without extensibility.

101. The fin of claim 100, wherein the materials with good resiliency and no extensibility are synthetic thermoplastic materials.

102. The fin of claim 101, wherein the materials are selected from the group consisting of polyethylene, polyurethane, polypropylene, PVC, EVA, PTE, or combinations thereof.

103. The fin of claim 101, wherein the materials are processed resins.

104. The fin of claim 101, wherein the resins are one or more layers selected from the group consisting of artificial, synthetic, natural braided, woven resins, and combinations thereof.

105. The fin of claim 55, further comprising closing elements for closing the gaps between the ribs, the closing elements being of materials having a good resiliency and a desired extensibility.

106. The fin of claim 105, wherein the materials are thermoset rubber materials.

107. The fin of claim 55, wherein the waterproof closure closes an entire surface of the blade.

108. The fin of claim 107, wherein the blade further comprises one or more apertures disposed at predetermined locations for water passage.

109. The fin of claim 55, wherein the ribs are directly connected to the central longitudinal member.

110. The fin of claim 55, wherein at least some ribs comprise higher resiliency connection portions having a hinging effect, the connection portions being disposed next to the longitudinal member.

111. The fin of claim 110, further comprising at least one weakening groove disposed on at least one face of the at least some ribs having the portions with the hinging effect includes.

112. The fin of claim 111, further comprising an elongated aperture on the portions having the hinging effect of the at least some ribs, the elongated aperture extending through a portion of a width of the rib, and two bridges each disposed at an end of the elongated aperture for connecting the rib to the longitudinal member.

113. The fin of claim 110, further comprising a plurality of apertures on the portions having a hinging effect of the at least some ribs, a plurality of bridges along the plurality of apertures for connecting each rib to the longitudinal member.

114. The fin of claim 55, further comprising a portion of the blade connected to the footpocket, and two apertures on the portion disposed on each side of the footpocket.

115. The fin of claim 55, wherein the fin further comprises two substantially triangular members on opposite sides of the longitudinal member, each triangular member comprising a relatively rigid plastic frame, the frame comprising a first element extending from the footpocket and widening toward an outside of the blade forming a starting portion of a peripheral edge, and a second element extending from the footpocket and narrowing toward the median longitudinal axis of the blade in a substantially triangular narrowing area leading from the footpocket to the longitudinal member, and a third element connecting ends of the first element and the second element being disposed towards the free end of the blade.

116. The fin of claim 115, wherein the triangular members are at least partly closed.

117. The fin of claim 116, wherein the triangular frame members (7) have each a substantially triangular aperture (407) for water passage.

118. The fin of claim 55, further comprising a pair of end ribs at the free end portion of the longitudinal member, the pair of end ribs extending from the longitudinal member and reaching an edge of the free end edge of the blade.

119. The fin of claim 118, wherein the pair of end ribs have a smaller width and length than other ribs.

120. The fin of claim 118, further comprising a transverse member connecting the two end ribs together along the edge of the free end edge of the blade forming a substantially triangular element, and an end section of the longitudinal member for dividing the triangular element into halves.

121. The fin of claim 120, wherein the triangular element comprises two apertures on opposite sides of the longitudinal member.

122. The fin of claim 121, wherein the triangular elements are closed.

123. The fin of claim 121, wherein the triangular elements are open.

124. The fin of claim 55, wherein the ribs and membrane portions therebetween have different colors.

125. The fin of claim 58, wherein membranes on the fin are transparent at least in the areas between ribs.

* * * * *